United States Patent [19]

Zinezi

[11] 4,116,392

[45] Sep. 26, 1978

[54] PULP REFINING DISK AND METHOD OF MAKING SAME

[75] Inventor: Waldemar Zinezi, Sao Paulo, Brazil

[73] Assignee: Inox Industria E Comercio de Aco S/A, Sao Paulo, Brazil

[21] Appl. No.: 770,273

[22] Filed: Feb. 22, 1977

[51] Int. Cl.[2] ..... B02C 7/12

[52] U.S. Cl. ..... 241/296; 76/101 A; 29/460; 407/54

[58] Field of Search ..... 29/460, 103 A; 76/101 A; 241/282.1, 292.1, 296, 298; 214/108, 111, 112

[56] References Cited

U.S. PATENT DOCUMENTS

| | | | |
|---|---|---|---|
| 1,090,533 | 3/1914 | Heinkel | 76/101 A |
| 1,532,040 | 3/1925 | Conradson | 76/101 A |
| 1,834,750 | 12/1931 | Trembour et al. | 164/108 |
| 2,036,656 | 4/1936 | Stowell et al. | 76/101 A |
| 2,278,958 | 4/1942 | White et al. | 164/108 |
| 3,574,914 | 4/1971 | Carter | 29/460 |

FOREIGN PATENT DOCUMENTS

| | | | |
|---|---|---|---|
| 2,053,394 | 5/1972 | Fed. Rep. of Germany | 241/296 |

*Primary Examiner*—Lowell A. Larson
*Attorney, Agent, or Firm*—Cesari and McKenna

[57] ABSTRACT

A pulp refining disk composed of an annular base and sets of radially oriented, tempered knife blades projecting from the base is formed by fabricating a model of the disk of wood or other soft material having the same profile as the intended finished disk, including projecting vanes corresponding to the blades in the finished disk. Then the disk model is pressed upside down into molding material to form a negative image of the disk model. Following removal of the model from the mold, tempered blades are placed cutting-edge-down into the slots formed in the mold by the vanes in the disk model, the blades being taller than the slots so that their back edges project somewhat into the part of the mold formed by the model base. Then one or more circular rings are positioned in the mold on the projecting back edges of the blades, concentric with the circular array of blades. Finally, a settable liquid is poured into the mold which flows around the back edges of the blades and around the rings so that when the material sets, there is formed solid annular blades projecting from the disk. The material sets at a temperature sufficiently low that the blades do not lose their temper.

3 Claims, 7 Drawing Figures

PULP REFINING DISK AND METHOD OF MAKING SAME

BACKGROUND OF THE INVENTION

This invention relates to a pulp refining disk and method of making same. It relates more particularly to a disk of this type comprising an annular base supporting a circular array of spaced-apart knife blades projecting from the base.

Vegetable pulp used in the manufacture of paper, cardboard and the like materials is often refined by means of rotating refining disks. These disks consist of an annular base and a circular array of spaced-apart knife blades projecting from the base. When the rotating disks are emersed in the pulp, the pulp fibers are cut or reduced to a greater or lesser extent. The desired degree of reduction depends upon the type or function of the paper being made from the pulp. This desired reduction is achieved by controlling the number of disks, the number of knife blades on the disks and the height and thickness of the blades.

The degree of hardness of the knife blades used in such disks must be fairly carefully controlled. If the blades are too hard, they tend to be breakable so that the refining disks have a relatively short useful life. On the other hand, if the knife blade hardness is too low, the blades tend to lose their temper under the heat generated due to the friction between the rotating disk and pulp. This also shortens the life of the disk.

Therefore, with this in mind, it becomes important to consider the means employed to attach the knife blades to the disk face. One refining disk presently in use comprises an annular base made of steel with a circular array of knife blades welded into the surface of the base. Besides being expensive, this type of pulp refining disk is relatively inefficient because in the course of welding the blades to the disk, the heat generated during the welding operation deforms the disk and also causes the blades to use their temper or hardness.

Other conventional pulp refining disks are made by a casting process in which a steel base is cast onto the backs of the blades arranged in a circular array. Here again, the heat developed during the casting operation adversely affects the hardness of the blades and places limits on the height and thickness of the blades. This, in turn, adversely affects the efficiency of the disks in reducing the pulp fibers. This method of making the disks is also relatively expensive.

SUMMARY OF THE INVENTION

Accordingly, the present invention aims to provide a pulp refining disk which is able to operate reliably and efficiently for a relatively long period.

Another object of the invention is to provide a pulp refining disk whose blades are precisely positioned on the disk base to effect the desired degree of refining.

Still another object of the invention is to provide a pulp refining disk whose knife blades have the requisite degree of hardness.

Yet another object of the invention is to provide a pulp refining disk which is relatively easy and inexpensive to make.

A further object is to provide a method of making a pulp refining disk that does not adversely affect the disk blades.

Still another object is to provide a method for making a pulp refining disk having one or more of the above characteristics.

Other objects will, in part, be obvious and will, in part, appear hereinafter.

The invention accordingly comprises the several steps and the relation of one or more such steps with respect to each of the others, and the article having the features, properties and the relation of elements, which are exemplified in the following detailed disclosure, and the scope of the invention will be indicated in the claims.

In accordance with the present method, a model of the desired finished disk is made of wood or other suitable material that is easily formed or worked. The model includes the usual flat annular base and a circular array of vanes projecting up from the base representing the disk blades. The model is then pressed vane-side-down into molding material to form a negative image of the disk model. Following removal of the model from the mold, fully tempered knife blades are positioned edge-side-down into the slots in the mold formerly occupied by the vanes. The knife blades are somewhat taller than the vanes and slots so that their backs project upward from the slots into the area of the mold formerly occupied by the disk model base. Then, one or more circular rings are positioned in the mold so that the rings rest on the upwardly projecting backs of the knife blades concentric with the array of blades. Finally a settable material is poured into the mold. Preferably this material is molten metal having a melting point considerably below the temperature that would adversely effect the hardness of the knife blades. On the other hand, settable material such as epoxy resin or other settable thermoplastic or thermosetting resins may be used as well. The material flows around the backs of the knife blades and around and between the rings filling the area of the mold formerly occupied by the disk model base. After the material sets, the resultant article is a fully formed refining disk comprising a solid flat annular base and a circular array of spaced-apart blades projecting from the base whose backs are securely imbedded and anchored in the base.

Using the foregoing process, refining disks can be made simply and quickly and economically without interferring with the properties or characteristics of the disk blades. On the contrary, the disk as a whole has the precise characteristics for the efficient execution of its intended function over a long period of use.

BRIEF DESCRIPTION OF THE DRAWINGS

For a fuller understanding of the nature and objects of the invention, reference should be had to the following detailed description taken in connection with the accompanying drawings in which.

DESCRIPTION OF THE PREFERRED EMBODIMENT

In accordance with the present process, a set of tempered knife blades 14 are prepared having the proper length, height, thickness and hardness required to form a particular refining function. The process for forming these blades is well known and will not be described here.

Figure 1:
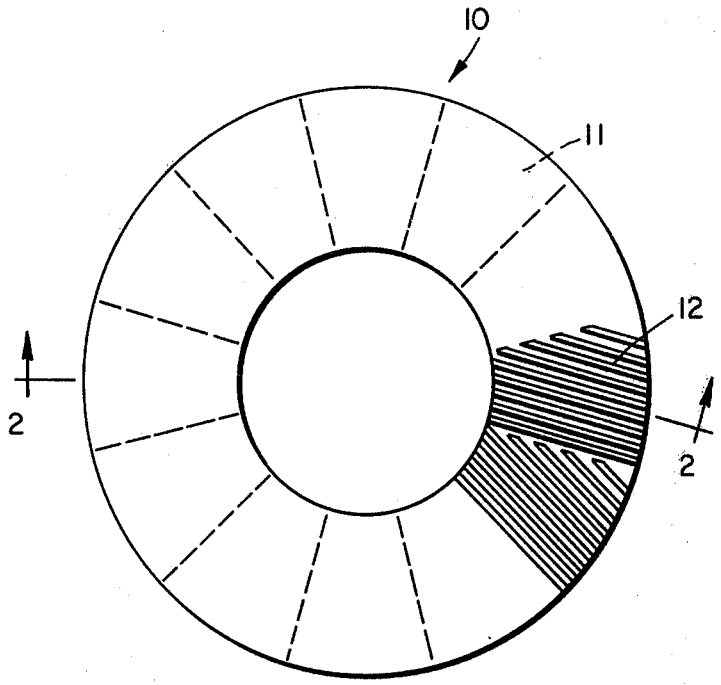
FIG. 1 is a plan view of a pulp refining disk model used to make a finished disk in accordance with the present technique.
Figure 2:
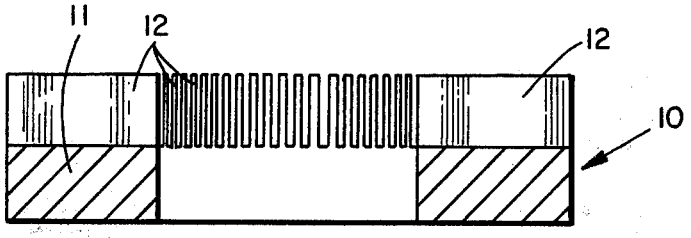
FIG. 2 is a sectional view along line A-A of FIG. 1.
Figure 7:
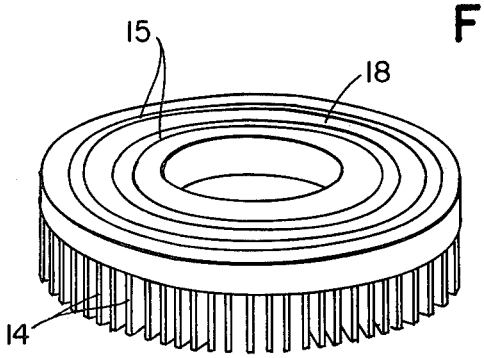
FIG. 7 is a perspective view of a finished refining disk made in accordance with this invention.

Also a model 10 shown in FIG. 1 and 2 of the finished disk illustrated in FIG. 7 is prepared out of wood, aluminum, silicon or other similar material which is easily worked to the desired shape. The model 10 comprises the usual flat, annular base 11 and a circular array of vanes 12 projecting up from the base, representing the knife blades in the finished disk. These vanes 12 may be formed integrally with the model base 10 or formed separately and attached to the base using any suitable means such as adhesive cement. These vanes 12 have the correct positions required for the knive blades in the finished disk.

Figure 3:
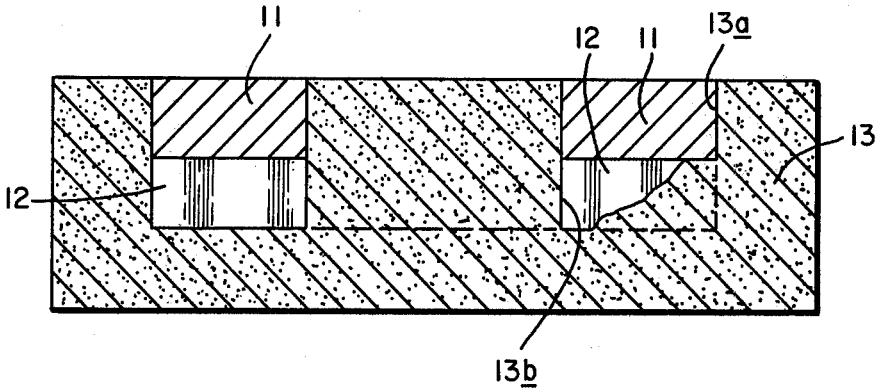
FIG. 3 to 6 are sectional views of the disk model and mold used to make the finished disk at different stages of the process.

Following the fabrication of the model 10, the model is turned upside down and pressed vane-side-down into suitable molding material illustrated in FIG. 3 as a mass 13 of casting sand. This forms a negative image of model 10 in the mold 13, which image includes an upper annular portion 13*a* corresponding to the model base 11 and a circular array of slots 13*b* projectingdown from area 13*a* corresponding to the model vanes 12.

Figure 4:
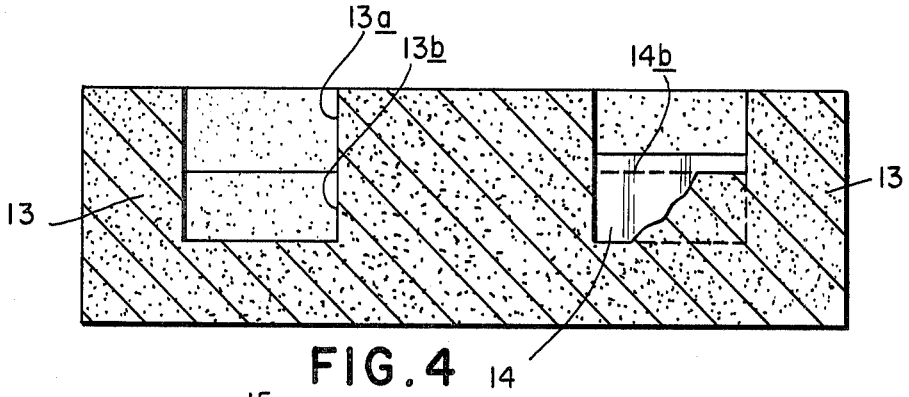

The model is then removed from the mold 13 and the previously prepared tempered blades 14 are placed edge-side down into the slots 13*b* in the mold as seen in FIG. 4. The thickness and length of the blades 14 are comparable to the thickness and length of slots 13*b*. However, the blades are somewhat taller than the slots so that their back edges 14*a* project somewhat into the area 13*a* in the mold as shown in FIGS. 4 and 5.

Figure 5:
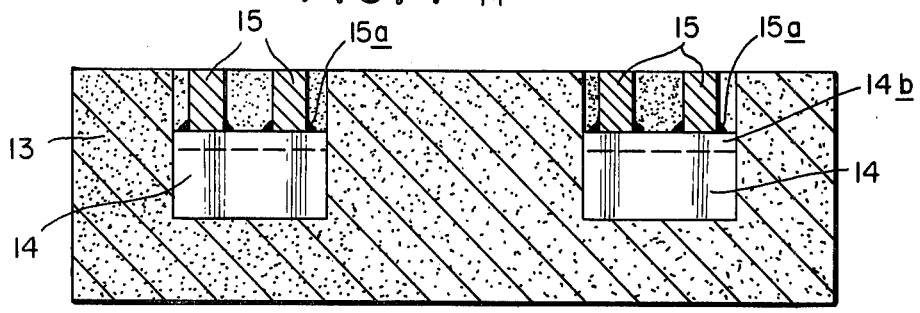
Figure 6:
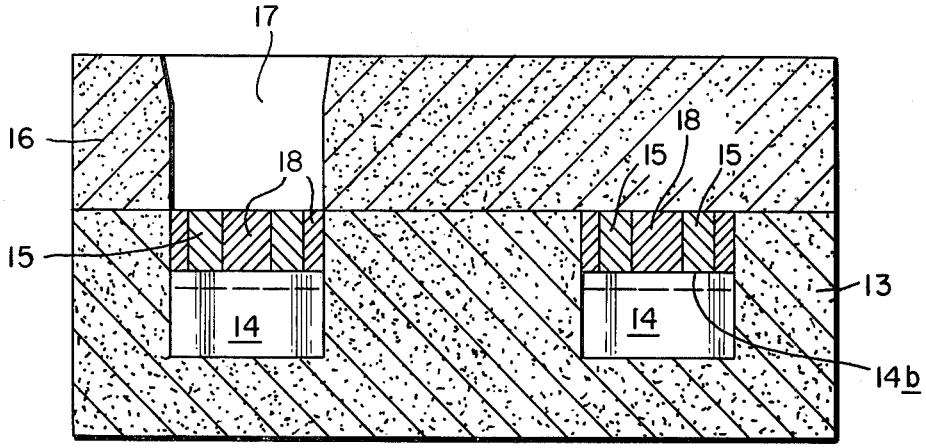

In order to provide a perfect interconnection of the blades in the array to preserve their orientation, one or more concentric rings 15 are placed in the mold, concentric with the blade array, the rings resting on the back edges 14*a* of the blades as shown in FIG. 5. The heights of the rings correspond to the distance between the backs of the blades and the top of the mold 13. Although it is not absolutely necessary, preferably the rings 15 are epoxied or spot welded to the backs of the blades as indicated at 15*a* in FIG. 5. The heat developed by such spot welding is not sufficiently high to adversely effect the blades.

Following this, the mold 13 is closed by a discoid cover 16 equipped with a flow passage or canal 17 through which settable material can be poured into the mold 13. This material may be metal, epoxy resin or other thermoplastic or thermosetting resin. However, it should be understood that the melting point of the material 18 or the temperature required to cause it to set is considerably less than the temperature that would adversely effect the blades 14 or cause them to lose their temper. For example, material 18 could be a metal having a melting point of 400°–500° C, while the blades 14 may be made of special steel which can withstand temperatures as high as 1600° C.

In any event, the material 18 flows into the mold area 13*a* between rings 15 and between the projecting back edges 14*a* of the blades 14. Thus the material 18 fills the whole internal area 13*a* seizing and firmly anchoring all of the knife blades 14 therein as well as connecting completely the rings 15.

After the article is cooled, the cover 16 is removed and the finished disk is taken out of the mold 13. If needed, it may be further burnished or polished to form the completed disk illustrated in FIG. 7. As seen in that figure, the finished article has a solid flat annular base formed of rings 15 and material 18 with a circular array of knife blades 14 projecting from the base which are firmly imbedded and anchored in the base. Consequently the placement and orientation of the blades in the finished disk is exactly as intended. Furthermore, the formation of the disk, while attaining a perfect union between the blades and the disk base, does not require the application of temperatures to the base high enough to impair the hardness of, or otherwise adversely affect, the blades.

It will thus be seen that the objects set forth above, among those made apparent from the preceding description are efficiently attained, and, since certain changes may be made in carrying out the above method and in the article set forth without departing from the scope of the invention, it is intended that all matter contained in the above description or shown in the accompanying drawings should be interpreted as illustrative and not in a limiting sense.

It is also to be understood that the following claims are intended to cover all of the generic and specific features of the invention herein described.

I claim:

1. The method of making a pulp refining disk comprising the steps of

A. fabricating a model which reproduces the intended disk, said model having a discoid base and a circular array of generally parallel vanes projecting from one side of the base representing the locations of the knife blades in the intended disk, said model being made of easily workable material, B. employing said model to form a negative image mold of the model, C. fabricating a plurality of tempered knife blades having approximately the same length and thickness as the model vanes but having a height in excess of said vanes, D. positioning the blades cutting-edge-side-down in the slots in the mold formerly occupied by the model vanes so that they form a circular array, E. placing one or more rings in the mold so that they rest on the margins of the blades projecting into the portion of the mold formerly occupied by the discoid model base, and so that they are coaxial with the blade array, F. securing the rings to said projecting blade margins, and G. casting settable material into the portion of the mold formerly occupied by the discoid model base whereby the material flows all around said rings and around both sides of the margins of the blades projecting into that portion so that when the material sets the finished article comprises a solid disk having a circular array of knife blades imbedded in and projecting from one side of the disk.

2. The method defined in claim 1 including the additional step of selecting a settable material which sets at a temperature considerably below the temperature that causes the blades to lose their temper.

3. A pulp refinging disk comprising

A. a circular array of spaced-apart, generally parallel knife blades whose cutting edges lie substantially in a common plane, said knife blades being made of a relatively high temperature resistent material, B. one or more rings engaging each blade at an edge thereof opposite the cutting edge, said rings being coaxial with the blade array, C. means for securing the rings to said opposite blade edges, and D. a casting of settable material having a relatively low melting or setting point engaging all around said rings and engaging around both sides of each blade at the edge thereof engaged by said rings so as to form a solid discoid base for the blades that firmly anchors the blades and preserves their orientation.

* * * * *